United States Patent [19]

Morawski

[11] Patent Number: 4,536,913

[45] Date of Patent: Aug. 27, 1985

[54] PAINT GUARD HAND TOOL

[76] Inventor: Janusz Morawski, 169 Dolomite Dr., Downsview, Ontario, Canada

[21] Appl. No.: 631,813

[22] Filed: Jul. 17, 1984

[51] Int. Cl.[3] ..... B05C 11/00

[52] U.S. Cl. ..... 15/257 R; 15/248 R; 118/504

[58] Field of Search ..... 15/106, 257 R, 248 R; 51/262 R, 272, 274, 310; 118/504, 505; 427/282, 300

[56] References Cited

U.S. PATENT DOCUMENTS

| | | | |
|---|---|---|---|
| 2,332,579 | 10/1943 | Kirby | 118/505 |
| 3,565,038 | 2/1971 | Van Barriger | 118/504 |
| 3,788,274 | 1/1974 | McNaughton et al. | 118/504 |
| 4,051,808 | 10/1977 | Trupp | 118/504 |
| 4,357,898 | 11/1982 | Fehrenbacher | 118/504 |
| 4,449,267 | 5/1984 | Siemion | 15/257 R |

*Primary Examiner*—Harvey C. Hornsby
*Assistant Examiner*—Arthur D. Dahlberg
*Attorney, Agent, or Firm*—George A. Rolston

[57] ABSTRACT

A hand tool comprising, a base panel, defining upper and lower surfaces, forward and rearward edges and two ends, a ridge formation extending generally upwardly from the forward edge of the base panel, the ridge formation including a front panel having a lower edge, first trough-defining member extending forwardly from the front panel, the first trough-defining member defining an upwardly directed trough and including an upwardly and forwardly directed first lip, a generally upwardly and rearwardly directed wall member extending from the rearward edge of the base panel, second trough-defining member extending generally rearwardly from the upper edge of the wall member, the second trough-defining member defining a downwardly directed trough and including a downwardly and rearwardly directed second lip, and, first stop members extending downwardly from the end of the base panel.

10 Claims, 4 Drawing Figures

PAINT GUARD HAND TOOL

NATURE OF THE INVENTION

The invention relates to a paint guard hand tool to be used to protect one surface from paint being applied to an adjacent surface, and is particularly directed to a two-sided tool having two different functions.

BACKGROUND OF THE INVENTION

It is commonly required in many environments, such as home or office, to paint one surface without desiring to place paint inadvertently or otherwise on an adjacent surface. In many instances, the adjacent surface is at right angles to the painted surface—thus presenting the problem of being able to paint into the corner formed therebetween. In many cases, if paint is inadvertently placed on the adjacent surface, damage thereto may result or the surface may have to be cleaned at great expense. For example, wall-to-wall carpeting on a floor may contact the bottom of a wall to be painted. If paint is placed on the carpet, the carpet may have to be replaced or entirely removed and cleaned. As a further example, a hardwood floor may meet a painted wall at its bottom. Commonly, quarter round strips are placed in the corner for aesthetic purposes. If it is desired to paint the quarter round strips, then care must be taken to avoid inadvertently placing paint on the hardwood floor. Otherwise, solvents may have to be used to remove the paint from the hardwood floor, thereby damaging the floor's surface finish and perhaps damaging its colouration. In yet a further example, it may be required to paint door or window frames without placing paint on the adjacent walls or glass panes. Many further examples exist where such painting problems are apparent.

In order to protect one surface from inadvertently receiving paint, two methods are in common use. First, the protected surface may be masked. Masking requires that tape, such as masking tape, attached to a sheet material such as newspaper, canvas, polyethylene sheets or the like, be placed as close to the surface to be painted as possible. Painting may proceed, and in fact paint may be applied over the masking tape and protective covering. When painting of the surface is complete, the masking tape and covering are removed, leaving paint only up to the location where the edge of the tape had been. The disadvantage of this method is that it takes considerable time and effort to ensure that the tape is securely in place at the desired locations, and that it is also securely attached to the protector sheet. Of course, the method also requires the use of bulky and perhaps expensive protector sheets. A further problem is that the protector sheets may be relatively difficult to clean. Furthermore, during the handling of the sheets which may still have wet paint thereupon, such wet paint may inadvertently touch and mar other surfaces or objects.

A second common method is to use a flat rigid sheet as a guard. Such a guard may be made out of any material, but typically may be made of stiff cardboard of sheet metal. One edge of the guard is placed at the desired location and the other edge is held in the hand. Paint is then applied on the desired surface right up to the edge of the guard. When paint has been applied along the length of the guard, the guard is moved to a new location and painting is continued. Use of such a guard results in several disadvantages. Generally speaking, the guard would be held at roughly 90° to the surface to be painted. One hand of the painter is used to hold the guard and to press the guard into place so that paint will not flow underneath the guard onto the protected surface. When paint is applied to the desired surface adjacent the guard, a small amount of paint will accumulate along the edge of the guard. When the guard is subsequently moved, such paint may be free to drip onto the protected surface. This problem is aggravated in the event that the guard is held at an acute angle with respect to the painted surface, such as where it is desired to paint a surface adjacent to or slightly below the top level of a carpet. In such an orientation, it may be difficult for the painter to fit the brush behind the guard without marring the newly painted surface or the handle of the paint brush. A further disadvantage is that, because of the flat shape of the guard, it may be difficult or uncomfortable to hold by hand.

It would be advantageous to provide a paint guard hand tool that is simple and convenient to use. Furthermore such a paint guard would not trap a significant amount of paint between the guard and the painted surface which could drip down onto the protected surface. It would be particularly advantageous if such a paint guard hand tool could be used to paint a surface down to or below the surface of a carpet without allowing paint to contact the carpet. It would also be advantageous if such a paint guard hand tool could be comfortably and conveniently held and manipulated by hand. As well, it would be a further advantage if such a hand tool were self supporting so that both hands of the painter could be free during the actual painting. A further desirable feature would be that the paint guard as far as possible not interfere with the application of paint onto the desired surface. For further convenience, the paint guard preferably has an edge useful for guiding a knife or cutting tool for trimming or cutting wallpaper or other sheet materials.

Preferably the tool can be fabricated at low cost from, eg. sheet metal, and will have two sides and two working edges. By simply turning the tool over from one side to the other, it can be used for a different purpose.

STATEMENT OF THE INVENTION

With a view to overcoming the above disadvantages and to providing the above advantages, the invention comprises a hand tool comprising, a base panel, defining upper and lower surfaces, forward and rearward edges and two ends, a ridge formation extending generally upwardly from the forward edge of the base panel, the ridge formation including a front panel having a lower edge, first trough-defining member means extending forwardly from the front panel, the first trough-defining member means defining an upwardly directed trough and including an upwardly and forwardly directed first lip, a generally upwardly and rearwardly directed wall member extending from the rearward edge of the base panel, second trough-defining member means extending generally rearwardly from the upper edge of the wall member, the second trough-defining member means defining a downwardly directed trough and including a downwardly and rearwardly directed second lip, and first stop members extending downwardly from the ends of the base panel.

The advantages of the invention are as follows:

Each edge of the paint guard hand tool defines an upturned lip relative to the surface being painted. Excess paint applied to the surface and the paint guard will flow downwardly over the lip into a trough defined in a guard. Little or no paint adheres to the surface to drip onto the unprotected surface.

One side of the guard is particularly convenient for use in painting a wall adjacent to a carpet. The angled corners of the guard force the carpet away from the immediate vicinity of the location where paint is being applied. A sharply angled downward wall allows the collection trough to be located below the surface level of the carpet. Stops are provided on each end of the guard to prevent the paint brush from passing over or splattering paint past the ends of the guard.

A ridge along the length of the guard provides a convenient hand grip for using the guard alongside a carpet. In the event that the hand is not holding the guard, the ridge will support the guard on the carpet while the edge of the guard is in place at the surface to be painted. Both hands of the painter are therefore freed.

The other side of the guard is used for painting on a hard surface. It defines a relatively wide flat trough for collecting excess paint. The end stops of the guard when inverted can support the guard in position on the hard surface to be protected while the edge of the guard is in place against the surface to be painted. In such orientation, the opposite side of the ridge defines a trough which also provides a suitable hand grip.

A further advantage is that in either orientation, the paint brush may be conveniently rested if desired on the guard, without damaging any surfaces or other objects. Both edges of the guard may be used to assist in trimming or cutting wallpaper.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
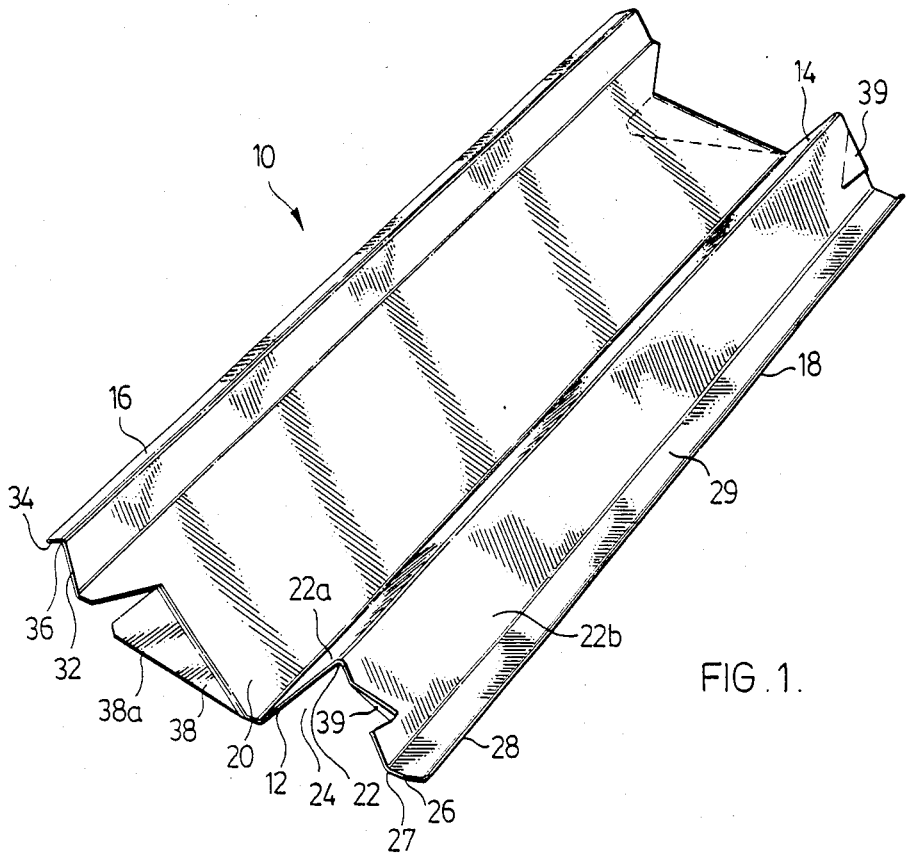
FIG. 1 is a perspective view of a paint guard hand tool according to the invention.

Referring to FIG. 1, there is illustrated a paint guard hand tool, indicated generally as 10, according to the invention. In plan view, paint guard 10 is comprised of a single piece of thin sheet material, such as sheet metal, and defines various longitudinal folds, ridges and troughs, as described below. Paint guard 10 defines two ends 12 and 14 and two edges 16 and 18. Edge 16 defines a carpet edge 16. The other edge 18 defines a non-carpet edge 18. Edges 16 and 18 are used as described below.

Guard 10 further defines a generally rectangular base panel 20, defining forward and rearward edges and upper and lower surfaces. A generally V-shaped ridge formation 22 extends upwardly from the forward edge of base panel 20. Ridge formation 22 has a rear panel **22*a* and a front panel 22*b*. The underside of ridge formation 22 defines a V-shaped trough 24**.

Extending generally forwardly from a lower edge 27 of front panel **22*b* is a spacer member 26 having an upturned lip 28. The free edge of lip 28 defines non-carpet edge 18. A paint receiving trough 29 is defined between spacer member 26, lip 28 and front panel 22*b***.

Angled wall member 32 extends upwardly and rearwardly from the rearward edge of base panel 20. Extending downwardly and rearwardly from the upper edge of wall member 32 is a lip 34. A paint receiving trough 36 is defined between lip 34 and wall member 32.

From each end of base panel 20, stop members 38 depend downwardly. Lower edges **38*a* of stop members 38 define a plane essentially co-planar with lower edge 27 of front panel 22*b*. Spacer member 26** defines a slight upward angle with respect to such plane.

Furthermore, a plane defined by the apex of the V-shaped ridge formation 22 and the uppermost portion of wall member 32 is essentially parallel with the plane defined by the lower edges **38*a* of stop members 38**.

Additional stop members 39 extend forwardly from front panel **22*b* of ridge formation 22**.

Figure 2:
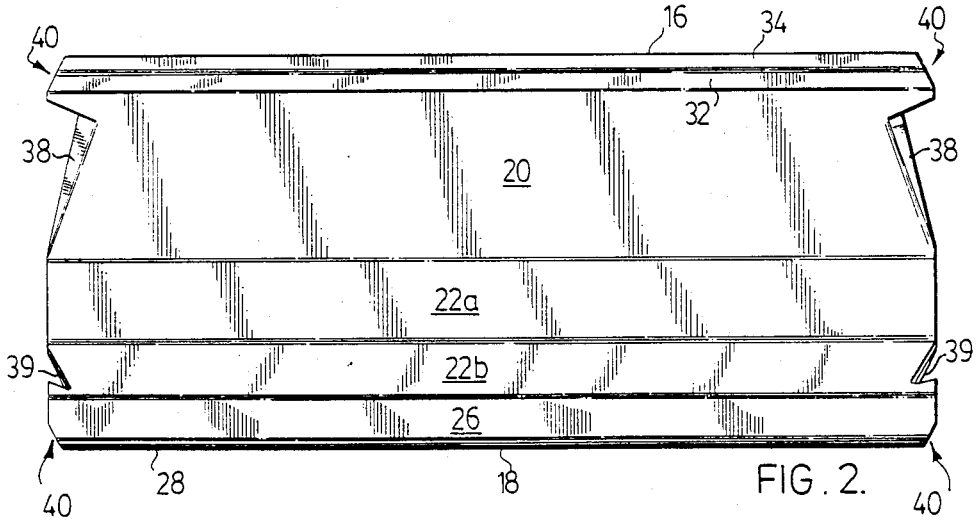
FIG. 2 is a plan view.

The distance from the upper side of rear panel **22*a* and non-carpet edge 18 is such that a human hand may comfortably fit around the apex of the V-shaped ridge formation 22 and non-carpet edge 18. Similarly, the distance between the underside of rear panel 22*a* and carpet edge 16 is also such that a human hand may conveniently fit from V-shaped trough 24 to carpet edge 16. As shown in FIG. 2 the corners, indicated generally as 40, of guard 10** are trimmed off and angled.

Figure 3:
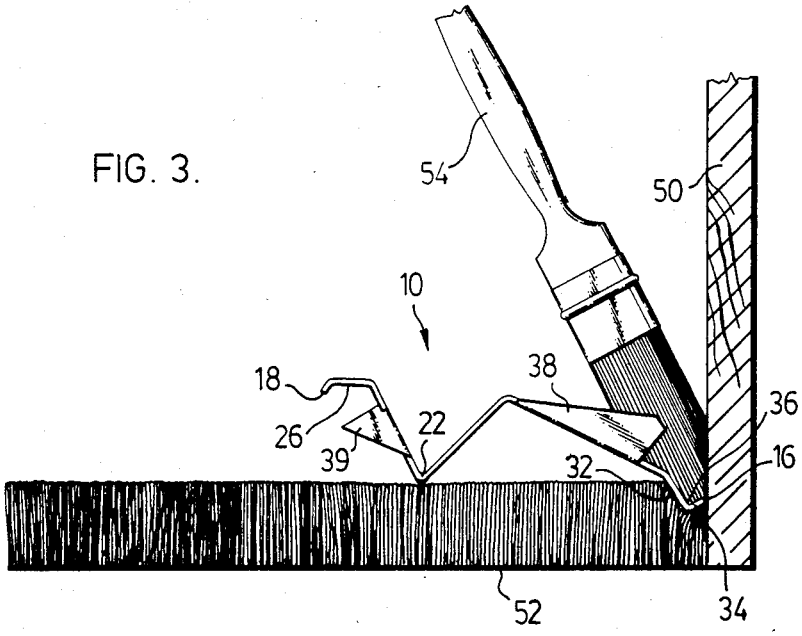
FIG. 3 is cross-section along the line 3—3 of FIG. 1, showing the invention in operation in association with a surface being painted and a carpeted surface, and, FIG. 4 is a cross-section along the line 4—4 of FIG. 1 showing the invention in operation in association with a surface being painted and a hard adjacent surface.

In operation, referring to FIG. 3, paint guard hand tool 10 is shown in one mode of operation in association with a wall 50, which is being painted, and a wall-to-wall carpet 52 located at the bottom of wall 50. Wall member 32 and lip 34 are inserted between wall 50 and the edge of carpet 52.

Wall 32, being at an angle will squeeze carpet 52 away from wall 50 and leave room for painting wall 50 below the carpet.

Paint guard 10 may be held by hand by extending a hand around the apex of V-shaped ridge formation 22 and non-carpet edge 18. Alternatively, as illustrated in FIG. 3, V-shaped ridge formation 22 rests upon the surface of the carpet 52. In such a position, both hands of the painter remain free. Carpet edge 16 is supported against the surface of wall 50. Brush 54 with paint thereon is applied to the surface of wall 50. Paint dripping down the surface of wall 50 is caught by lip 34 and directed into receiving trough 36 where it is held. It is not necessary to, at any time, prevent brush 54 from contacting guard 10. Brush 54 is brushed along the length of guard 10. At each end, stop members 38 assist to prevent brush 54 from passing beyond the end of the guard 10. Furthermore, stop members 38 may also assist to prevent splattering of paint from side to side. When the surface of wall 50 has been adequately coated with paint along the length of guard 10, the guard 10 is moved an appropriate amount to one side or the other, so that a new portion of the surface of wall 50 may be painted. During such sideways motion, the cut-away portions of corners 40 of guard 10 assist to move the strands of carpet 52 away from wall 50 and paint receiving trough 36, thereby decreasing the danger of exposing such strands of carpet 52 to paint. In the new location, painting resumes as described above. During the movement of guard 10, the spacer member 26 may serve as a convenient finger-hold for moving the guard 10 by hand. The depth of paint receiving trough 36, beneath the surface of rug 52 may be adjusted as desired.

Figure 4:
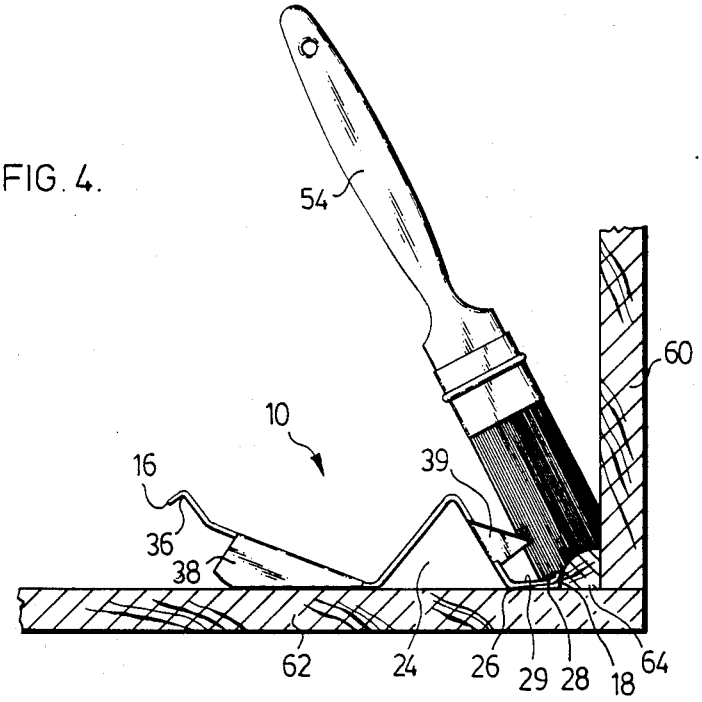

Referring to FIG. 4, the guard 10 is shown in another mode of operation in association with a wall 60 and a hardwood floor 62. A quarter round strip 64 may be located at the junction between wall 60 and floor 62. Guard 10 is used the other way up. It may be held by hand with a hand extending between V-shaped trough 24 and carpet edge 16. Alternatively, guard 10 may rest on floor 62 with non-carpet edge 18 contacting flush against quarter round 64. In such orientation, stop members 38 act as supports, to hold paint guard 10 steady. Paint is applied by a brush 54 to wall 60 and quarter round strip 64. Excess paint drips down over non-carpet edge 18 onto lip 28 into paint receiving trough 29. Spacer member 26 extends forwardly a sufficient amount whereby brush 54 may be conveniently used without interfering with paint already applied to wall 60 and without interfering with paint guard 10. Stop members 39 assist to prevent brush 54 from passing beyond the ends of the guard 10. Stop members 39 may also assist to prevent splattering of paint from side to side.

When it is desired to move paint guard 10 to a new location, it is moved to either side, as desired. The now inverted paint receiving trough 36 offers a satisfactory fingerhold for moving the guard 10 by hand. As guard 10 is moved, paint already applied to wall 60 of quarter round 64 may flow somewhat below the lip 28. Such flow is acceptable and in fact necessary for aesthetically pleasing paint work, as the non-carpet edge 18 of lip 28 is somewhat above the surface of floor 62. In any event such flow will be minimal because the majority of the excess paint will have flowed into trough 29.

Because spacer member 26 is angled upwardly relative to the floor, the height of non-carpet edge 18 above the floor may be adjusted by tipping the guard 10 slightly forward. The painter can estimate the desired height according to the viscosity of the paint and the amount of paint applied adjacent to guard 10. Fine adjustments can be made by hand by holding guard 10 at inverted trough 36.

In either mode of operation, if the painter decides to rest momentarily, the brush 54 may be laid on guard 10. Guard 10 will of course prevent paint from contacting the protected surface.

Either edge may also be used for guiding a knife or other cutting tool for cutting or trimming wall-paper or other sheet materials. The tool can also be used when painter around window glass, or door or window trim alongside a wall.

In a further embodiment, suitable indentations may be made in base portion 20 and rear surface **22*a*** for a more comfortable handgrip.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A paint guard hand tool comprising:

a base panel, defining upper and lower surfaces, forward and rearward edges and two ends;

a ridge formation extending generally upwardly from the forward edge of the base panel, the ridge formation including a front panel having a lower edge;

first trough-defining member means extending forwardly from the front panel, the first trough-defining member means defining an upwardly directed trough and including an upwardly and forwardly directed first lip;

a generally upwardly and rearwardly directed wall member extending from the rearward edge of the base panel;

second trough-defining member means extending generally rearwardly from the upper edge of the wall member, the second trough-defining member means defining a downwardly directed trough and including a downwardly and rearwardly directed second lip, and, base stop members extending downwardly from the base panel.

2. A paint guard hand tool as claimed in claim 1 including front stop members extending forwardly from the front panel.

3. A paint guard hand tool as claimed in claim 2 wherein the ridge formation has an inverted V-shaped cross-section.

4. A paint guard hand tool as claimed in claim 3 wherein lowermost edges of the first stop members define a first plane, the lower edge of the front panel being coplanar with the first plane.

5. A paint guard hand tool as claimed in claim 4 wherein the first trough-defining member means defines an angle with respect to the first plane, whereby in operation the height of the first lip above a surface may be adjusted by a human operator holding the tool.

6. A paint guard hand tool as claimed in claim 5 wherein an uppermost portion of the second trough-defining member means and an apex of the V-shaped ridge formation define a second plane, being essentially parallel to the first plane.

7. A paint guard hand tool as claimed in claim 6 wherein corners of the tool are bevelled.

8. A paint guard hand tool as claimed in claim 7 wherein the base panel and the ridge formation define indentations, whereby the operator may grip the tool.

9. A paint guard hand tool as claimed in claim 7 wherein the distances between the first lip and the ridge formation and between the second lip and the ridge formation are suitable for grasping the tool by hand between the ridge formation and a lip.

10. A paint guard hand tool as claimed in claim 9 wherein the tool comprises sheet metal.

* * * * *